US011345535B2

(12) United States Patent
Staus

(10) Patent No.: US 11,345,535 B2
(45) Date of Patent: May 31, 2022

(54) LIQUID MIXING APPARATUS AND METHOD

(71) Applicant: Matthew Staus, Chandler, AZ (US)

(72) Inventor: Matthew Staus, Chandler, AZ (US)

( * ) Notice: Subject to any disclaimer, the term of this patent is extended or adjusted under 35 U.S.C. 154(b) by 225 days.

(21) Appl. No.: 16/830,055

(22) Filed: Mar. 25, 2020

(65) Prior Publication Data

US 2020/0307893 A1 Oct. 1, 2020

Related U.S. Application Data

(60) Provisional application No. 62/824,147, filed on Mar. 26, 2019.

(51) Int. Cl.

| | |
|---|---|
| ***B65D 81/32*** | (2006.01) |
| ***B01F 13/00*** | (2006.01) |
| ***B01F 33/501*** | (2022.01) |

(52) U.S. Cl.

CPC .... *B65D 81/3288* (2013.01); *B01F 33/50111* (2022.01); *B65D 81/3211* (2013.01); *B65D 81/3255* (2013.01)

(58) Field of Classification Search

CPC ..... B65D 81/3288; B65D 81/3255; B65D 81/3211; B01F 13/0022; B01F 33/50111

See application file for complete search history.

(56) References Cited

U.S. PATENT DOCUMENTS 5,071,042 A * 12/1991 Esposito ..... B65D 25/48 222/570
6,976,578 B1 12/2005 Kenihan
7,377,383 B2 5/2008 Henry
8,152,017 B2 4/2012 Lizerbram et al.
8,172,079 B2 5/2012 Greenberg et al.
8,302,803 B1 11/2012 Greenberg et al.
8,365,960 B1 2/2013 Kalaouze
8,376,135 B1 2/2013 Greenberg et al.
8,453,834 B2 6/2013 Porter
8,662,351 B2 3/2014 Kalaouze
8,684,231 B2 4/2014 Lane et al.
(Continued)

OTHER PUBLICATIONS

Form PCT/ISA/210 International Search Report and PCT/ISA/237 Written Opinion of the International Searching Authority from International Patent Application No. PCT/US2020/024736, which claims priority to U.S. Appl. No. 16/830,055.

*Primary Examiner* — Frederick C Nicolas
(74) *Attorney, Agent, or Firm* — Parsons & Goltry, PLLC; Michael W. Goltry; Robert A. Parsons

(57) ABSTRACT

Liquid mixing apparatus includes a housing having an open lower end and a pour opening normally sealed with a closure. A bottom assembly extending across the open end of the housing and sealingly engaged in the open end for relative rotation between the housing and the bottom assembly. The bottom assembly forms a liquid sealed cavity with the housing and further includes apparatus for removably attaching the bottom assembly to a liquid container. A mixing opening defined in the horizontal wall with a flapper valve pivotally mounted therein for pivotal movement between a closed orientation and an open orientation. A stop bar attached at a lower surface to the upper surface of the horizontal wall and extending across a mid-portion of the mixing opening. An activating bar affixed to the housing for rotation with the housing.

17 Claims, 12 Drawing Sheets

(56) References Cited

U.S. PATENT DOCUMENTS

| | | | | |
|---|---|---|---|---|
| 8,708,181 | B2 | 4/2014 | Buck | |
| 9,359,183 | B2 | 6/2016 | Henderson | |
| 10,279,977 | B2 * | 5/2019 | Fleischman | B65D 81/3211 |
| 10,577,153 | B2 * | 3/2020 | Ayeni | B65D 17/4012 |
| 2005/0098561 | A1 | 5/2005 | Schwoebel | |
| 2010/0055252 | A1 | 3/2010 | Marina et al. | |
| 2011/0303561 | A1 * | 12/2011 | Zheng | B01F 13/0022 206/219 |
| 2012/0017766 | A1 | 1/2012 | Anson et al. | |
| 2012/0298532 | A1 | 11/2012 | Woolf et al. | |
| 2017/0043932 | A1 * | 2/2017 | Byun | B65D 81/3255 |
| 2017/0267407 | A1 * | 9/2017 | Lott | B65D 25/085 |
| 2019/0062033 | A1 | 2/2019 | Fleischman et al. | |
| 2020/0231360 | A1 * | 7/2020 | May | B65D 81/3211 |

* cited by examiner

LIQUID MIXING APPARATUS AND METHOD

CROSS-REFERENCE TO RELATED APPLICATION

This application claims the benefit of U.S. Provisional Patent Application No. 62/824,147, filed 26 Mar. 2019.

FIELD OF THE INVENTION

This invention relates to liquid mixing apparatus and methods of use. In particular, the present invention relates to mixing liquids by combining containers.

BACKGROUND OF THE INVENTION

In the field of mixed liquids, mixing a first liquid with a second liquid to provide a third liquid composed of the mixed first liquid and second liquid is often desirable. This is particularly used in mixed drinks, although other liquids are often mixed as well. It is well-known that the spirits industry suffers from a lack of convenience because of the relatively large bottles in which alcoholic beverages are sold. A user must pour the spirit/alcohol from the large bottle into a drink type container (e.g. cup, glass, etc.), add potable ice and then a mixer. If the user has taken the large bottle of alcohol with them to an affair, they must either leave the partially used bottle at the location or remember to return home with it. However, many states do not allow individuals to drive with an open spirits container in the vehicle thus raising a dilemma.

Smaller container sizes for spirits are known, but they still require the inconvenience of using a separate container to receive spirits from one container and a mixer from another container to adequately combine and mix the components.

It would be highly advantageous, therefore, to remedy the foregoing and other deficiencies inherent in the prior art.

It is an object of the present invention to provide new and improved liquid mixing apparatus.

It is another object of the present invention to provide new and improved liquid mixing apparatus that, for example, conveniently contains a chosen amount of liquid for mixing purposes, combinable with fluid in another container.

It is another object of the present invention to provide new and improved mixing apparatus that is attachable to another liquid container for mixing the liquids therein.

It is another object of the present invention to provide new and improved liquid mixing apparatus and a method of mixing liquid contained in the apparatus with another container of liquid.

SUMMARY OF THE INVENTION

Briefly to achieve the desired objects and advantages of the instant invention in accordance with a preferred embodiment a liquid mixing apparatus is disclosed. The apparatus includes a housing having an upper containment wall and an open lower end, the upper containment wall including a pour opening sealed with a closure. A bottom assembly includes a horizontal wall extending across the open lower end of the housing and is sealingly engaged in the open lower end for relative rotation between the housing and the bottom assembly. The bottom assembly forms a liquid sealed cavity with the housing. The bottom assembly further includes connecting apparatus for removably attaching the bottom assembly to a liquid container. A mixing opening is defined in the horizontal wall of the bottom assembly and a flapper valve is pivotally mounted in the mixing opening for pivotal movement between a closed orientation in which liquid in the cavity cannot flow through the mixing opening and an open orientation in which liquid can flow through the mixing opening. A stop bar is attached at a lower surface to the upper surface of the horizontal wall and extends across a mid-portion of the mixing opening and an activating bar is affixed to the housing for rotation with the housing, whereby relative rotation between the housing and the bottom assembly moves the activating bar within the cavity, forcing liquid in the cavity to pivot the flapper valve into the open orientation in which liquid can flow through the mixing opening.

To further achieve the desired objects and advantages of the present invention liquid mixing apparatus includes a housing having an upper containment wall and an open lower end, the upper containment wall includes a pour opening sealed with a closure. A bottom assembly includes a horizontal wall extending across the open lower end of the housing and a sealing ring extending around the periphery of the horizontal wall. The sealing ring sealingly engages an inner surface of the housing adjacent the open lower end, and the sealing ring engages the inner surface of the housing to allow relative rotation between the housing and the bottom assembly. The bottom assembly forms a liquid sealed cavity with the housing. The bottom assembly further includes connecting apparatus for removably attaching the bottom assembly to a liquid container. The connecting apparatus includes the sealing ring also having a downwardly opening ring-shaped channel designed to sealingly engage an upwardly extending lip of a liquid container. A mixing opening is defined in the horizontal wall of the bottom assembly and a flapper valve is pivotally mounted in the mixing opening for pivotal movement between a closed orientation in which liquid in the cavity cannot flow through the mixing opening and an open orientation in which liquid can flow through the mixing opening. A stop bar is attached at a lower surface to the upper surface of the horizontal wall. The stop bar is generally rectangular in shape and extends radially along the upper surface of the horizontal wall from adjacent an inner surface of the housing to approximately a central point of the housing and extends across a mid-portion of the mixing opening. An activating bar is affixed to the housing for rotation with the housing. The activating bar is generally rectangular in shape and extends radially along the lower surface of the upper containment wall from adjacent an inner surface of the housing to approximately a central point of the housing, whereby relative rotation between the housing and the bottom assembly moves the activating bar within the cavity, forcing liquid in the cavity to pivot the flapper valve into the open orientation in which liquid can flow through the mixing opening.

To further achieve the desired objects and advantages of the present invention a method of mixing single serving drinks is disclosed. The method includes the steps of providing a drink container including a generally cylindrical body with an upper sealing wall having a top pour opening normally sealed with a closure and an upwardly extending lip 19 which extends above upper sealing wall providing single serving drink mixing apparatus including a housing having an upper containment wall and an open lower end, the upper containment wall including a pour opening sealed with a closure, and a bottom assembly including a horizontal wall extending across the open lower end of the housing and sealingly engaged in the open lower end for relative rotation between the housing and the bottom assembly, the bottom assembly forms a liquid sealed cavity with the housing, the bottom assembly further including connecting apparatus for removably attaching the bottom assembly to a drink container. A mixing opening is defined in the horizontal wall of the bottom assembly and a flapper valve is pivotally mounted in the mixing opening for pivotal movement between a closed orientation in which liquid in the cavity cannot flow through the mixing opening and an open orientation in which liquid can flow through the mixing opening. A stop bar is attached at a lower surface to the upper surface of the horizontal wall and extending across a mid-portion of the mixing opening and an activating bar is affixed to the housing for rotation with the housing, whereby relative rotation between the housing and the bottom assembly moves the activating bar within the cavity, forcing liquid in the cavity to pivot the flapper valve into the open orientation in which liquid can flow through the mixing opening. A flexible seal is removably affixed to the lower surface of the horizontal wall of the bottom assembly over the mixing opening in the horizontal wall of the bottom assembly. The method further includes the steps of removing the closure from the top pour opening in the drink container and removing the flexible seal over the mixing opening, removably attaching the bottom assembly to the upwardly extending lip of the drink container, rotating the housing relative to the drink container, and removing the closure from the pour opening.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION

Disclosed is a liquid container that can easily be attached to or combined with another container of liquid, and liquid in the container easily mixed into the liquid in the other container. In this disclosure the container applies most conveniently to alcoholic drinks but may be applied to any drink in which one liquid is mixed into another, generally larger quantity of liquid. Thus, while drinkable liquids are described in the preferred embodiment, it will also be understood by one of ordinary skill in the art, that other liquids, either consumable or not, can also be employed in the apparatus of the present invention.

Figure 1:
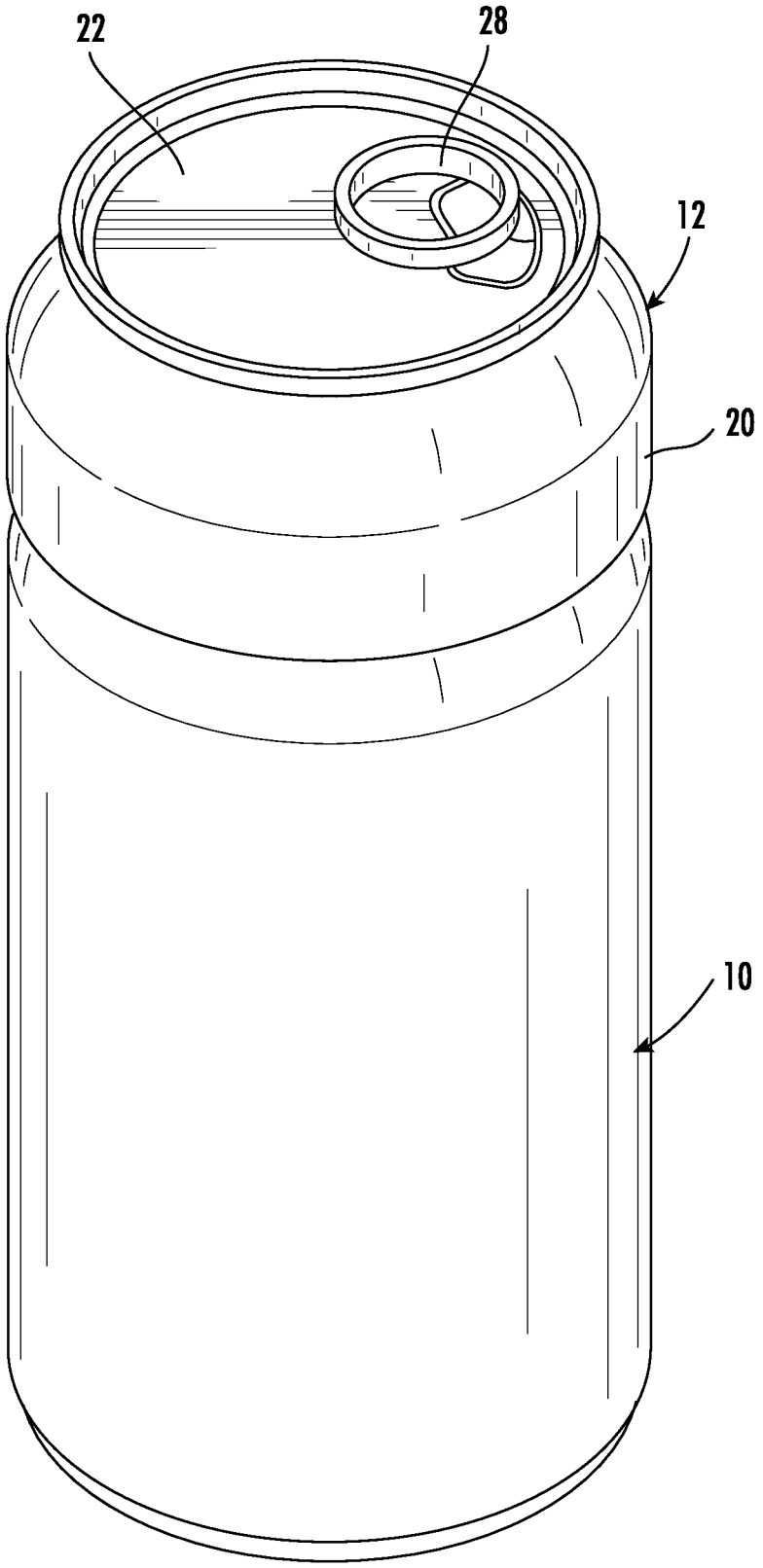
FIG. 1 is a perspective top view of a typical liquid container with a liquid mixing apparatus, according to the present invention, attached thereto.
Figure 2:
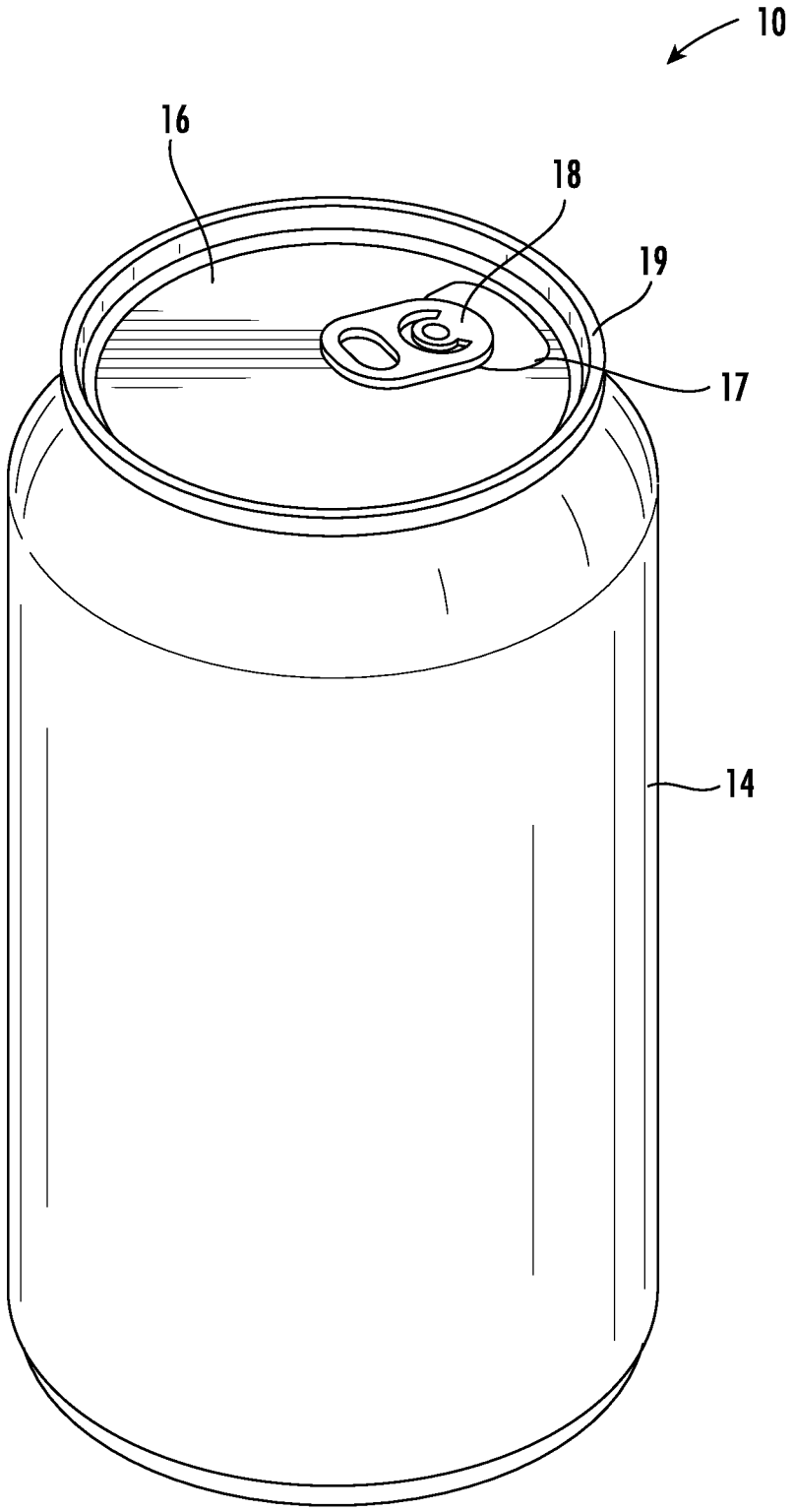
FIG. 2 is a top perspective view of the typical liquid container of FIG. 1 with the example of liquid mixing apparatus removed or not yet attached.

Turning now to the drawings in which like reference characters indicate corresponding elements throughout the several views, attention is directed to FIG. 1 which illustrates a typical liquid container 10 with an example of liquid mixing apparatus 12 attached thereto. Typical liquid container 10 is illustrated individually in FIG. 2 and, as will be understood by those of ordinary skill in the art, can contain any of a wide variety of liquids including cola, flavored drinks, soda, water, seltzer, beer, juice, etc. Liquid container 10 includes a generally cylindrical body 14 with an upper sealing wall 16 having a top pour opening 17 normally sealed with a closure such as pull-tab 18 in a well-known manner. Liquid container 10 also includes an upwardly extending lip 19 which extends above a perimeter of upper sealing wall 16. While a conventional mixer can such as soda water is illustrated, one of ordinary skill in the art will understand that many other container shapes can be utilized with the apparatus of the present invention.

Figure 3:
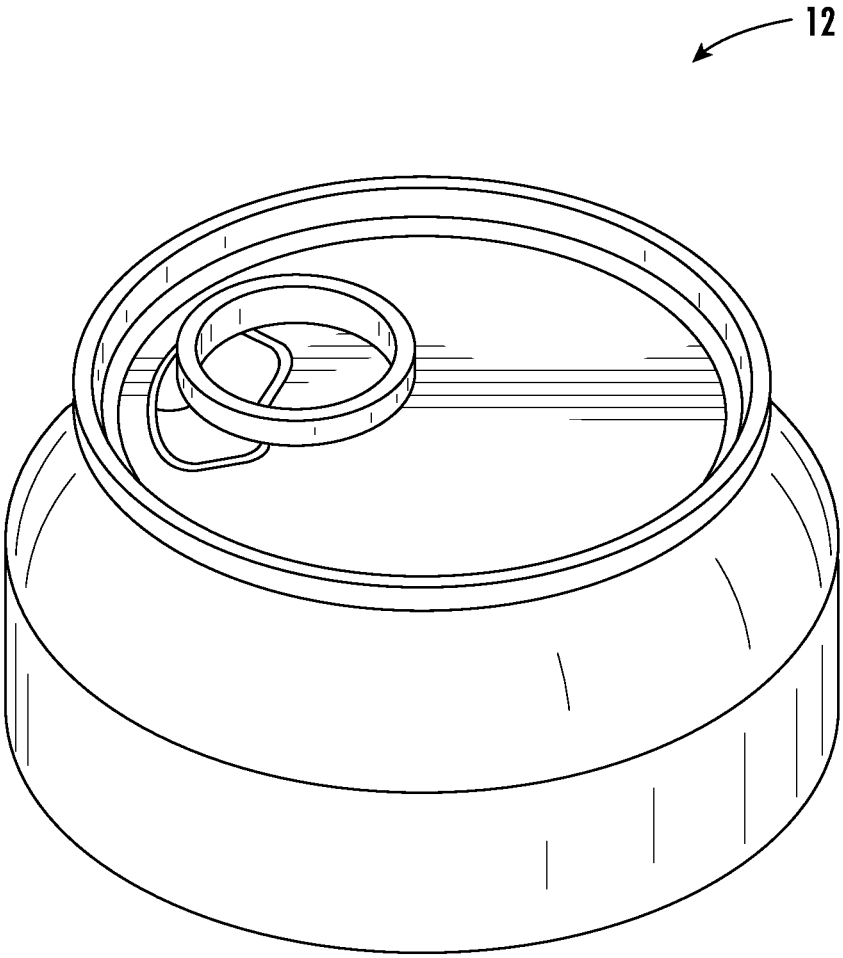
FIG. 3 is a top perspective view of the example of liquid mixing apparatus of FIG. 1 prior to attachment to the typical liquid container of FIG. 2.

A preferred embodiment of liquid mixing apparatus 12 is illustrated individually in FIG. 3 and, as will be understood by those of ordinary skill in the art, can contain any of a wide variety of materials including spirits/alcohol (e.g. whiskey, brandy, gin, vodka, tequila, etc.) or any liquid to be mixed into any of the wide variety of liquids described above (e.g. lemon or any other fruit flavors). In this specific embodiment, liquid mixing apparatus 12 is formed of plastic. In the present disclosure, for purposes of example only, liquid mixing apparatus 12 contains spirits/alcohol.

Figure 4:
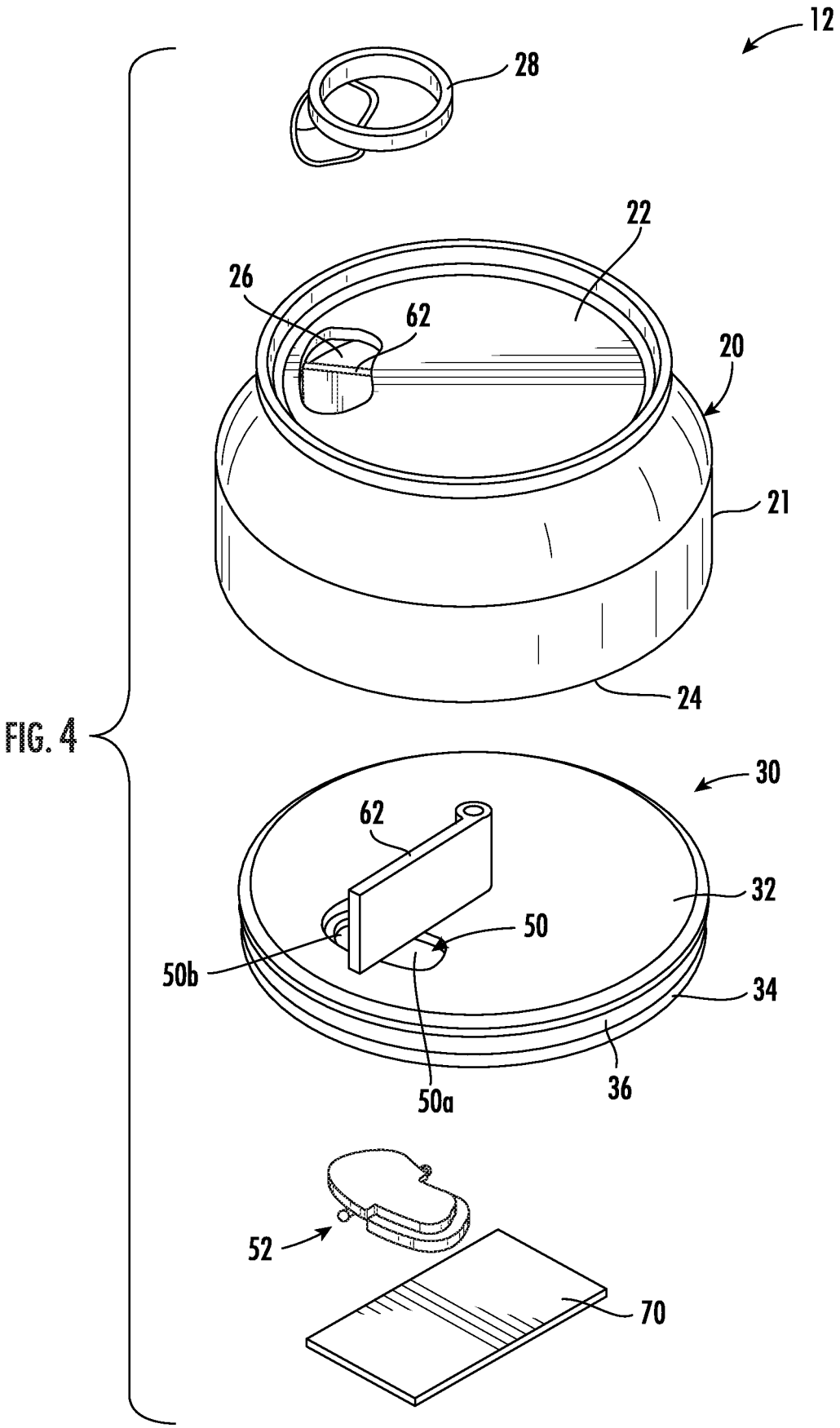
FIG. 4 is a top exploded view of the liquid mixing apparatus of FIGS. 1 and 3.

Turning to FIG. 4, the various components of liquid mixing apparatus 12 are illustrated in an exploded view. Liquid mixing apparatus 12 includes a housing 20 including sidewall 21, an upper containment wall 22 and a lower opening 24. In this preferred embodiment, housing 20 is constructed similar to an upper portion of typical liquid container 10 with the bottom open (i.e. lower opening 24).

Upper containment wall 22 includes a top pour opening 26 normally sealed with a closure such as pull-tab 28 similar to pull-tab 18 of liquid container 10. Lower opening 24 of housing 20 is sealed by a bottom assembly 30, the structure of which within housing 20 can best be seen by referring additionally to FIG. 5.

Figure 5:
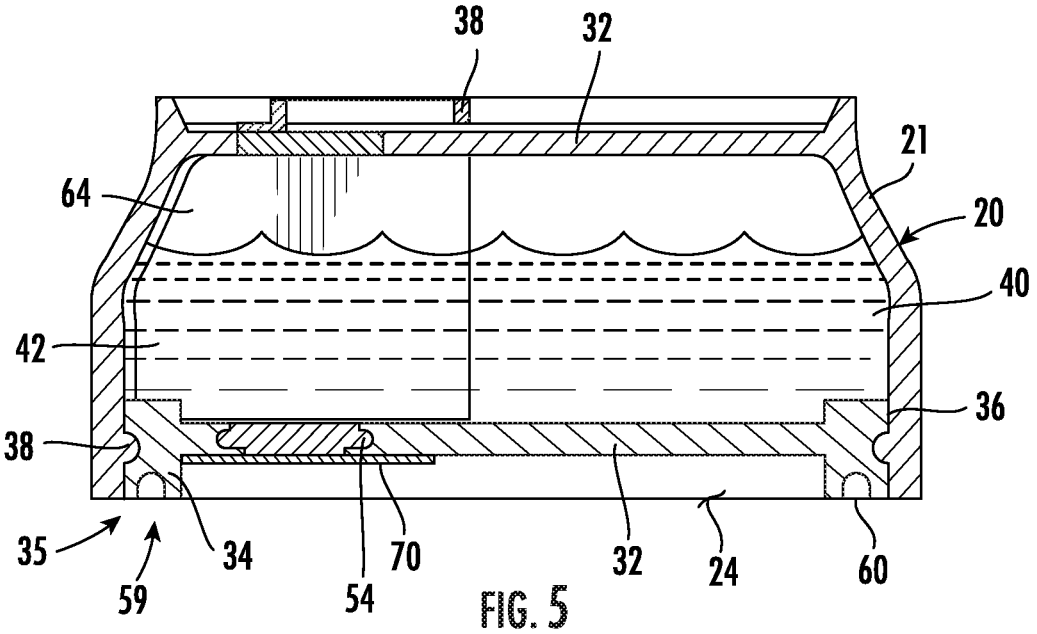
FIG. 5 is a sectional side view of the liquid mixing apparatus of FIGS. 1 and 3 showing internal components.
Figure 6:
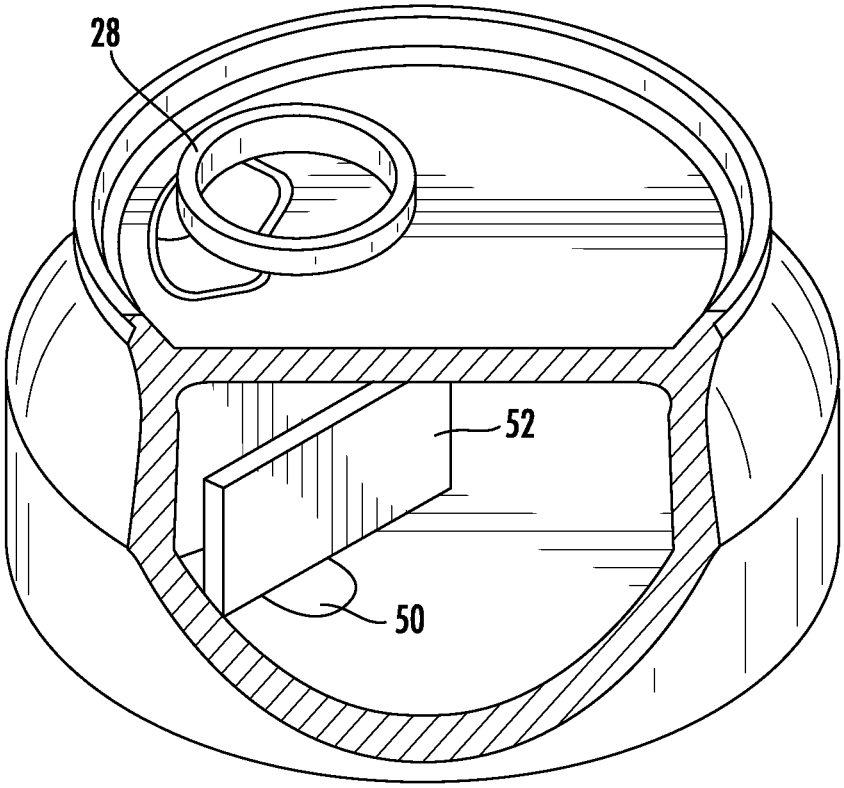
FIG. 6 is a top perspective view of the liquid mixing apparatus of FIGS. 1 and 3 with a portion broken-away to illustrate inner components.
Figure 7:
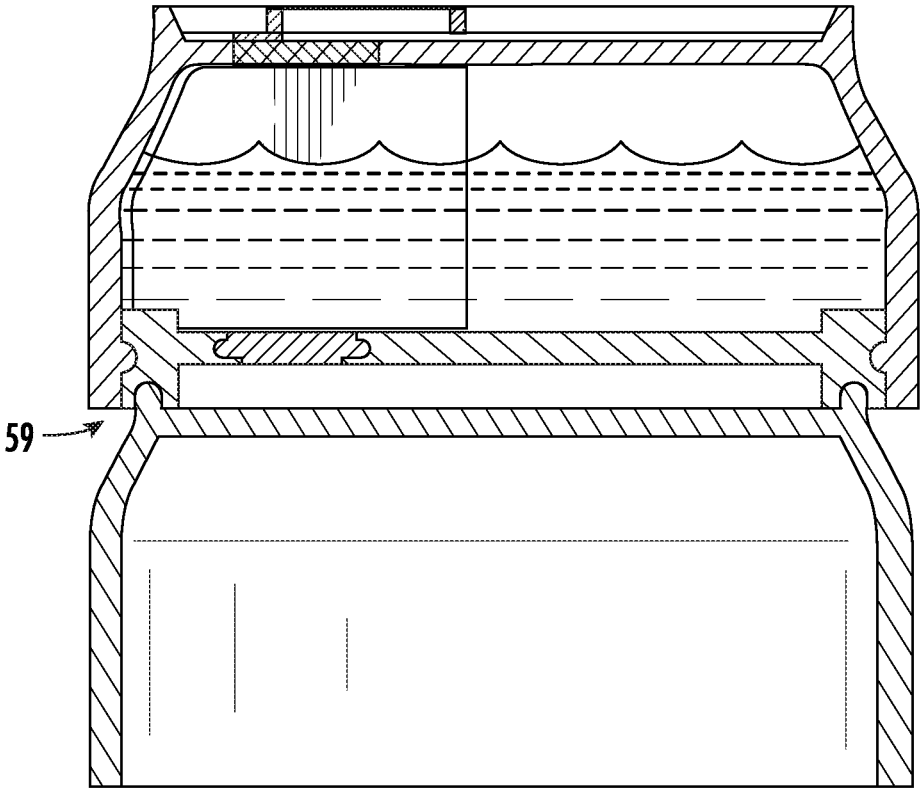
FIG. 7 is a sectional side view of the typical liquid container with the liquid mixing apparatus attached thereto, according to the present invention.

Bottom assembly 30 includes a horizontal wall 32 that extends across the entire lower opening 24 in housing 20. In this specific embodiment, sealing apparatus 35 rotatably couples bottom assembly 30 to housing 24. Sealing apparatus 35 includes a sealing ring 34 integrally formed with horizontal wall 32. Sealing ring 34 extends around the entire periphery of wall 32. Sealing ring 34 is designed to fit tightly within the inner periphery of sidewall 21 of housing 20 proximate the lower edge thereof, and has an outwardly opening groove 36 extending completely around the outer periphery approximately midway between the upper and lower edges of sealing ring 34. A detent-like inwardly directed tongue 38 extends from the inner periphery of sidewall 21 of housing 20 proximate the lower edge thereof to mate with groove 36 and seal horizontal wall 32 and sealing ring 34 in lower opening 24 of housing 20. Here it should be specifically noted that groove 36 of sealing ring 34 receives detent-like tongue 38 and the outer periphery of sealing ring 34 engages the inner periphery of housing 20 to allow limited relative rotation therebetween while providing a liquid seal. In this manner, bottom assembly 30 mates with the lower edge of housing 20 to form a sealed (leak proof) cavity 40 between bottom assembly 30 and housing 20. Also, it will be understood that the positions of groove 36 and detent-like inwardly directed tongue 38 can be reversed. As can be seen in FIG. 5, cavity 40 is substantially filled with a liquid 42 to be mixed with a liquid contained in liquid container 10 to provide a new liquid composed of a mixture of the liquid contained in cavity 40 and the liquid contained in liquid container 10.

Figure 13:
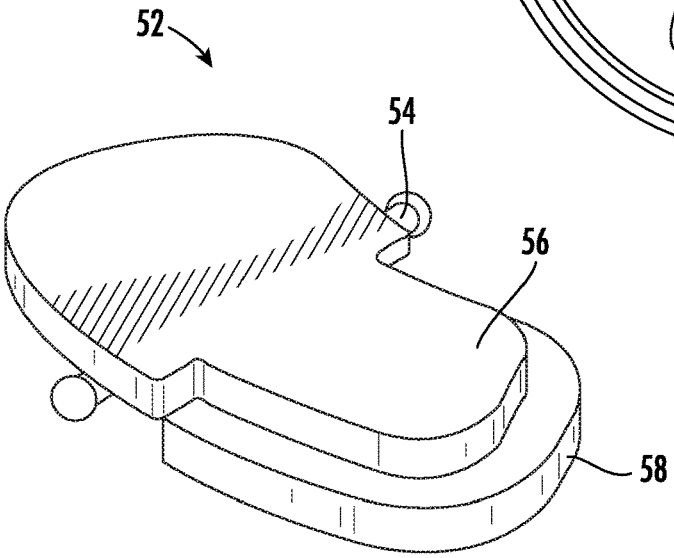
FIG. 13 is a top perspective view of a flapper valve component of the liquid mixing apparatus of FIGS. 1 and 3.
Figure 14:
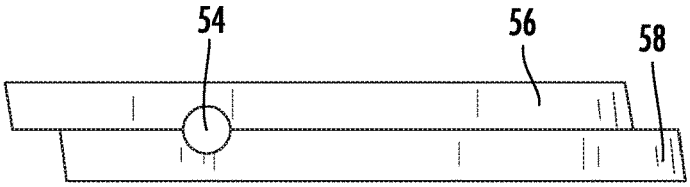
FIG. 14 is a side view of the flapper valve component of the liquid mixing apparatus illustrated in FIG. 13.

Bottom assembly 30 also includes a mixing opening 50 defined in horizontal wall 32 intermediate the inner wall of housing 20 and a center of horizontal wall 32. A mixing flapper valve 52 (enlarged views in FIGS. 13 and 14) is pivotally attached in opening 50 by means of a pivot pin 54. Flapper valve 52 includes an upper layer 56 having a shape corresponding the to the shape of opening 50. A second lower layer 58 is formed on the underside of upper layer 56 and having essentially the same shape. Upper layer 56 and lower layer 58 are offset relative one another with upper layer 56 shifted to the left relative lower layer 58, such that opposing ends of flapper valve 52 have an overlying portion and an underlying portion. In the closed position, the overlying portion overlies horizontal wall 32 adjacent one end of opening 50, while the underlying portion underlies horizontal wall 32 adjacent the opposite end of opening 50. This ensures opening movement of flapper valve 52 in a single direction. The overlapping portions of upper layer 56 and lower layer 58 correspond to the shape of opening 50 and is formed to fit snuggly into opening 50 to substantially prevent fluid (i.e. liquid 42) from flowing through opening 50 when flapper valve 52 is in the closed position. It will be understood that the same effect can be achieved by having a single layer forming flapper valve 52 with a tab extending from the top surface at one end and a tab extending from the bottom surface at the opposing end. Thus, flapper valve 52 is positioned in opening 50 and is free to pivot, clockwise in FIG. 13, from a closed position into an open or mixing orientation.

In this embodiment of sealing apparatus 35, sealing ring 34 of bottom assembly 30 also includes connecting apparatus 59 for removably affixing bottom assembly 30 and housing 20 to upwardly extending lip 19 of liquid container 10. In this preferred embodiment, connecting apparatus 59 includes a downwardly opening ring-shaped channel 60 with a diameter approximately the same diameter as upwardly extending lip 19 of liquid container 10. Ring-shaped channel 60 is specifically shaped and sized to snap-fit onto upwardly extending lip 19 of liquid container 10. That is, the term "snap-fit" is defined herein such that ring-shaped channel 60 sealingly engages upwardly extending lip 19 of liquid container 10 and while being removably engaged, enough force is required to disengage ring-shaped channel 60 from upwardly extending lip 19 that it cannot be inadvertently disengaged, for example by tipping or shaking liquid container 10 with liquid mixing apparatus 12 attached thereto.

Figure 11:
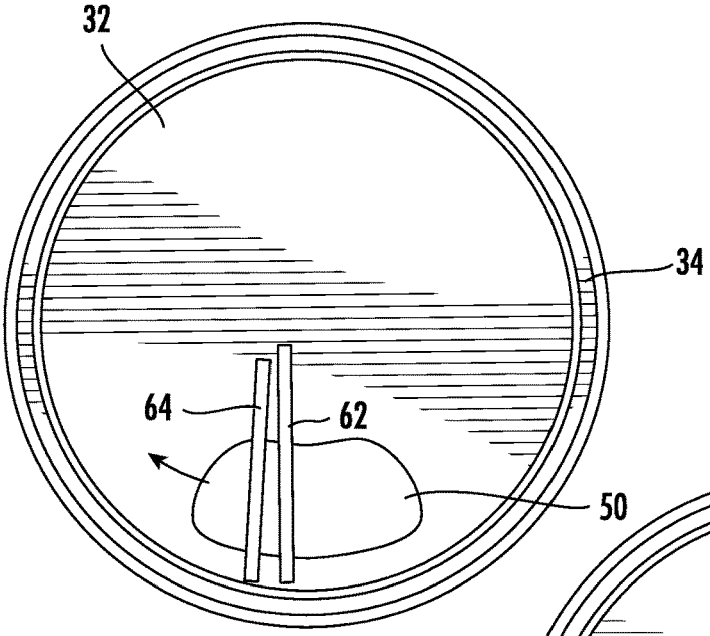
FIG. 11 is cross-sectional top view of the liquid mixing apparatus of FIGS. 1 and 3 illustrating the bottom wall and attached components in a closed and locked orientation.
Figure 12:
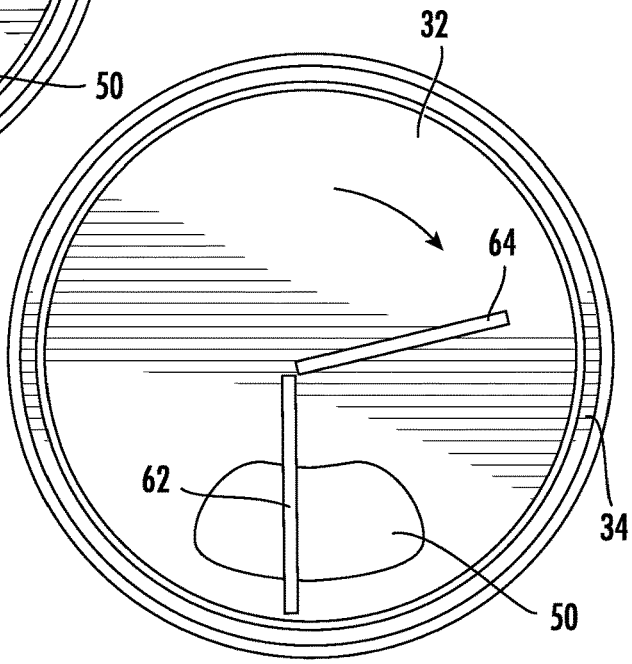
FIG. 12 is cross-sectional top view of the liquid mixing apparatus of FIGS. 1 and 3 illustrating the bottom wall and attached components in an unlocked orientation.

Referring specifically to FIGS. 5, 6, 11, and 12, a stop bar 62, generally rectangular in shape, is attached at a lower surface to the upper surface of horizontal wall 32 and extends across opening 50 from near the center of horizontal wall 32 to adjacent the inner wall of housing 20. Thus, stop bar 62 is fixed relative to opening 50. An activating bar 64 is attached to housing 20 either to the lower surface of upper containment wall 22, sidewall 21, or both. Activating bar 64 is initially positioned adjacent to stop bar 62 and over flapper valve 52 in a locking position, as illustrated in FIG. 11. Activating bar 64 extends downwardly from upper containment wall 22 into sliding engagement with the upper surface of flapper valve 52 and the upper surface of horizontal wall 32. Activating bar 64 is in a locking position initially (FIG. 11) and blocks flapper valve 52 from pivoting, but is free to rotate with housing 20 relative to horizontal wall 32 (FIG. 12). It should be understood that while stop bar 62 and activating bar 64 are generally rectangular in shape in this preferred embodiment, they are shaped to conform to the shape of housing 20 in which they are employed. Specifically, sidewall 21 may have an irregular cross-sectional shape, sloped, or bottle shaped, and the like. Stop bar 62 and activating bar 64 are shaped to fit therein.

Figure 8:
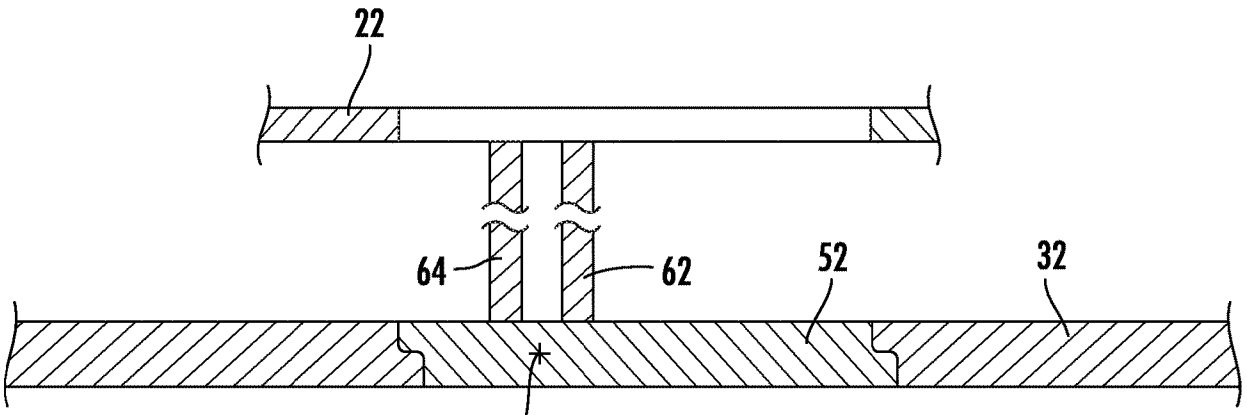
FIG. 8 is a partial sectional side view of the liquid mixing apparatus of FIGS. 1 and 3, in a closed orientation.
Figure 9:
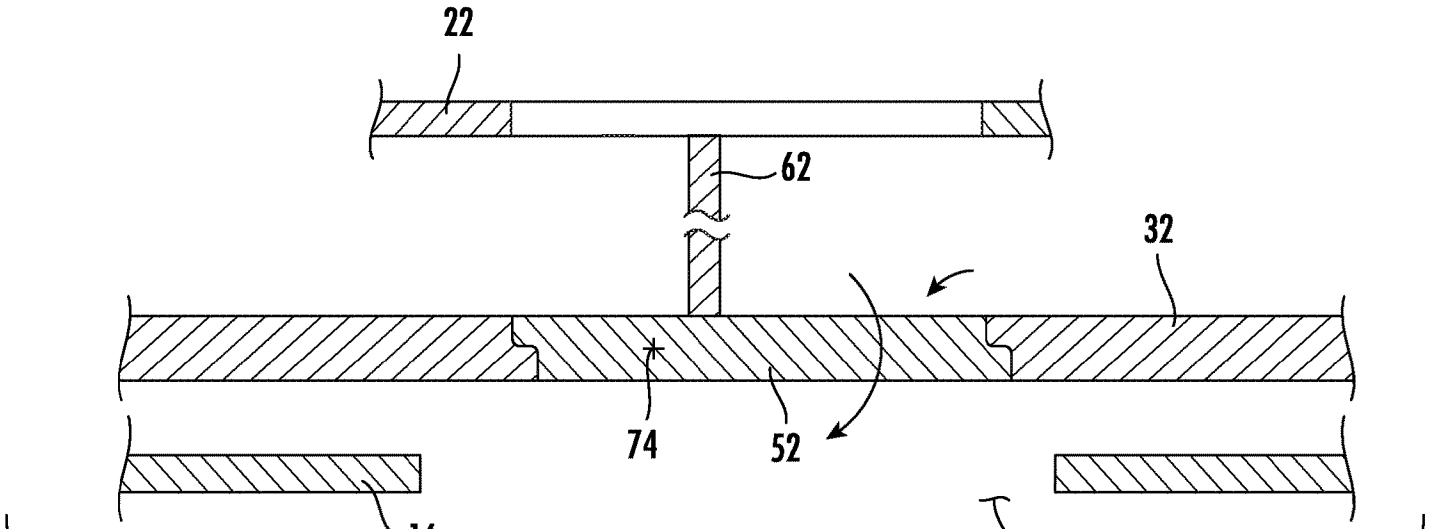
FIG. 9 is a partial sectional side view of the liquid mixing apparatus of FIGS. 1 and 3, in an unlocked orientation.
Figure 10:
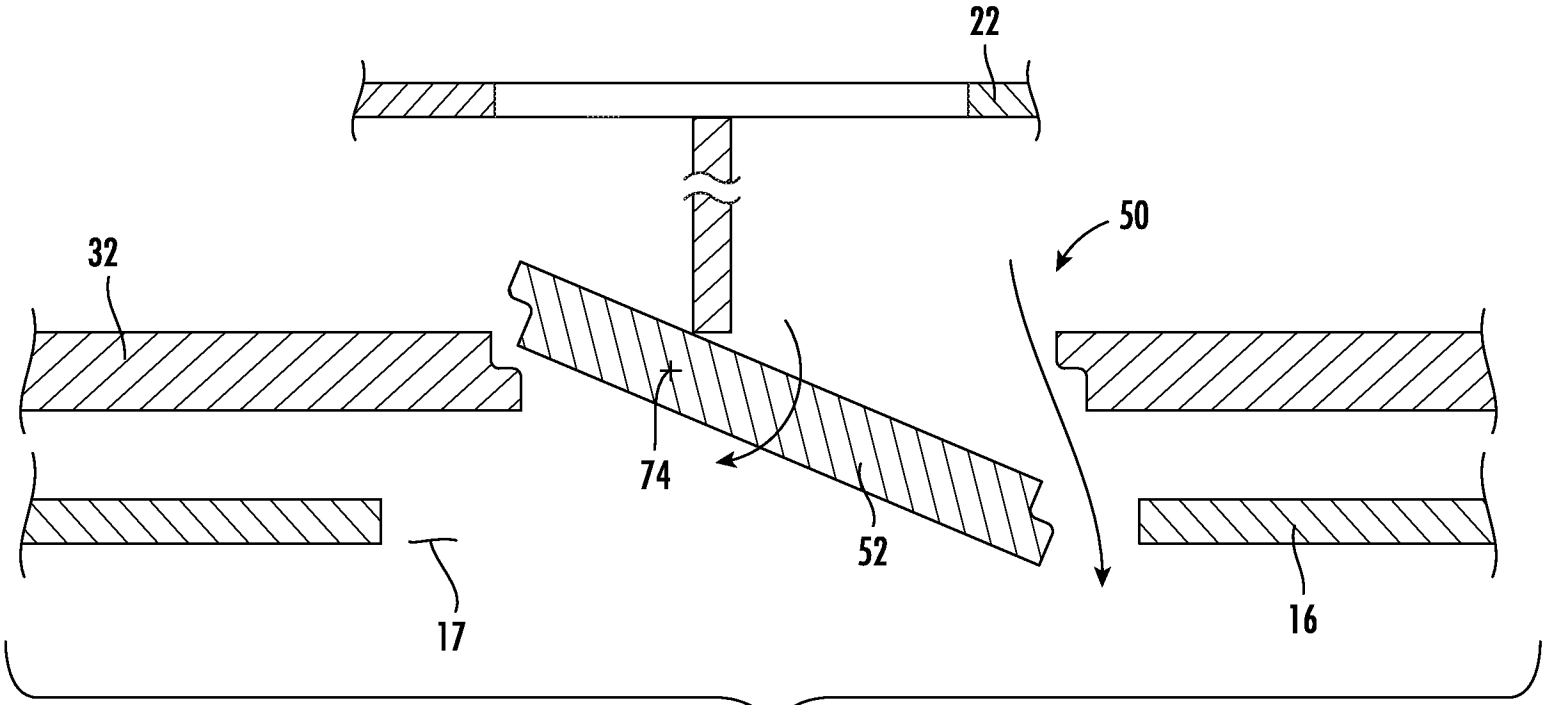
FIG. 10 is a partial sectional side view of the liquid mixing apparatus of FIGS. 1 and 3, in an unlocked an open orientation.

Referring additionally to FIGS. 8-10, relative movement of activating bar 64 and flapper valve 52 is illustrated in more detail. Referring specifically to FIG. 8, in the initial position activating bar 64 is situated directly over opening 50 to the left of stop bar 62. The pivot point of flapper valve 52 is represented by a cross designated 74. It can be seen that flapper valve 52 is locked in the closed orientation by activating bar 64. When housing 20 is rotated relative to bottom assembly 30, activating bar 64 is moved clockwise away from flapper valve 52, freeing flapper valve 52 for pivotal movement about pivot point 74, as illustrated in FIG. 9. Also, clockwise rotation of activating bar 64 forces liquid 42 in cavity 40 toward stop bar 62, pivoting the right-hand portion of flapper valve 52 downwardly as illustrated in FIG. 10. To facilitate the pivoting of flapper valve 52 to the open position, pivot point 74 is offset in a direction toward the overlying portion of flapper valve 52, with a corresponding offset of stop bar 62. Offset of pivot point 74 results in opening of flapper valve 52 under the weight of the fluid contained within cavity 40 alone. The pivotal movement of flapper valve 52 opens opening 50 and allows liquid 42 to flow into liquid container 10 through a portion 50*a* of one side of opening 50. Since liquid container 10 is typically full of liquid, liquid 42 flowing into liquid container 10 will force excess liquid out of liquid container 10 and up through the portion 50*b* of the opposing side of opening 50. This exchange of liquid will cause a swirling/mixing of the two liquids so that, in the case of spirits, a completely mixed single serving drink results.

Figure 15:
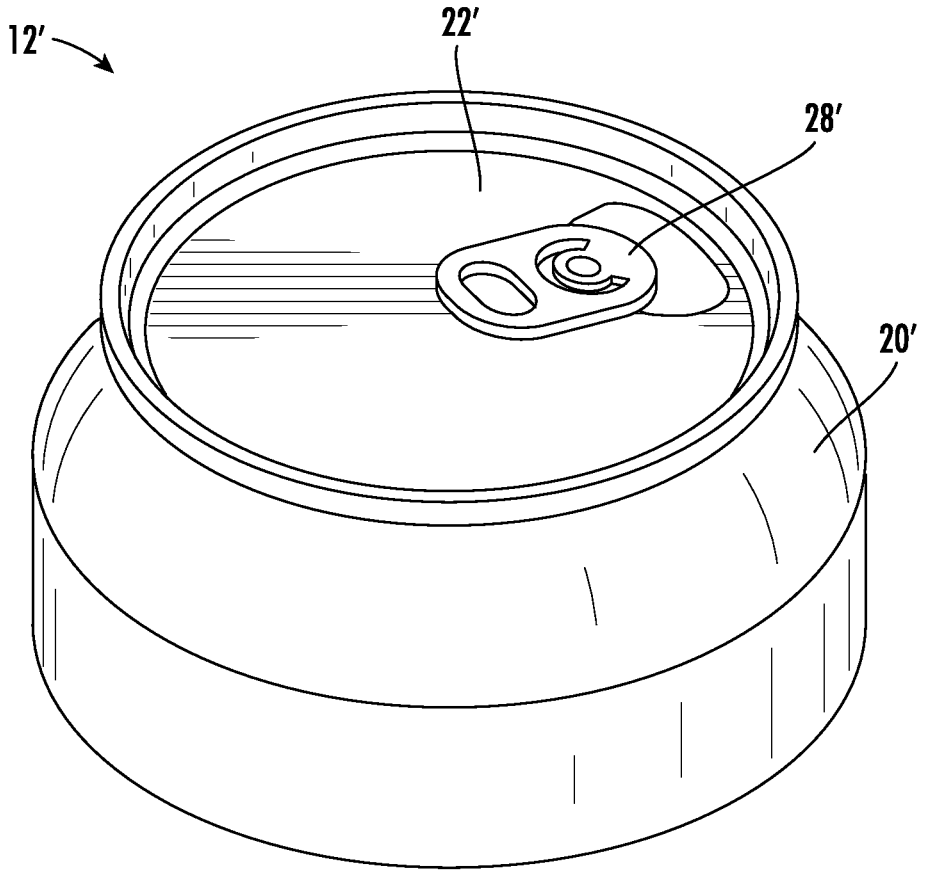
FIG. 15 is a top perspective view of another embodiment of a liquid mixing apparatus similar to FIG. 3.

Turning to FIG. 15, another embodiment of liquid mixing apparatus 12 is illustrated. In this embodiment components similar to those in FIG. 3 are designated with the same number having a prime (') added to represent the different embodiment. Whereas, in FIG. 3 drink mixing apparatus 12 is formed of plastic material, in this embodiment liquid mixing apparatus 12' is formed of aluminum material. Thus, for example, the different pull-tabs 28 and 28' which are designed to operate with the different material.

Figure 16:
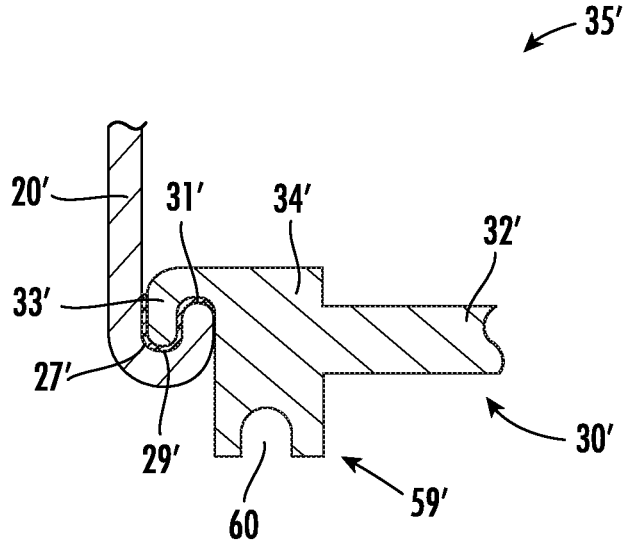
FIG. 16 is an enlarged sectional view illustrating a portion of another embodiment of sealing apparatus.

Turning to FIG. 16, another embodiment of sealing apparatus 35 is illustrated. In this embodiment components similar to those described in FIG. 5 are designated with a similar number and a prime (') is added is indicate the different embodiment. In this specific embodiment sealing apparatus 35' rotatably couples bottom assembly 30 to housing 20, includes a sealing ring 34' integrally formed with horizontal wall 32'. Sealing ring 34' extends around the entire periphery of horizontal wall 32'. Sealing ring 34' includes an outwardly extending flange with a downwardly extending arm 33' at the outer edge that forms a downwardly directed U-shaped channel 31' around the entire outer periphery of sealing ring 34'. The lower edge of housing 20', around the entire periphery is bent inwardly and upwardly to form an upwardly directed U-shaped channel 29' that is designed specifically to mate with downwardly directed U-shaped channel 31' in a liquid sealing arrangement. Here it should be noted that this embodiment of sealing apparatus 35' is best adapted to the aluminum housing 20' of FIG. 15. One or both of U-shaped channels 29' and 31' are coated with a material 27' (e.g. plastic, Teflon, etc.) that allows relative rotary movement between housing 20' and sealing apparatus 35' while preventing the flow of liquid from housing 20'.

In this embodiment of sealing apparatus 35', sealing ring 34' of bottom assembly 30' also includes connecting apparatus 59' for removably affixing bottom assembly 30' and housing 20' to upwardly extending lip 19 of liquid container 10. In this preferred example, connecting apparatus 59' includes a downwardly opening ring-shaped channel 60' with a diameter approximately the same diameter as upwardly extending lip 19 of liquid container 10. Ring-shaped channel 60' is specifically shaped and sized to snap-fit onto upwardly extending lip 19 of liquid container 10. That is, the term "snap-fit" is defined herein such that ring-shaped channel 60' sealingly engages upwardly extending lip 19 of liquid container 10 and while being removably engaged, enough pressure is required to disengage ring-shaped channel 60' from upwardly extending lip 19 that it cannot be inadvertently disengaged, for example by tipping or shaking liquid container 10 with liquid mixing apparatus 12' attached thereto.

Figure 17:
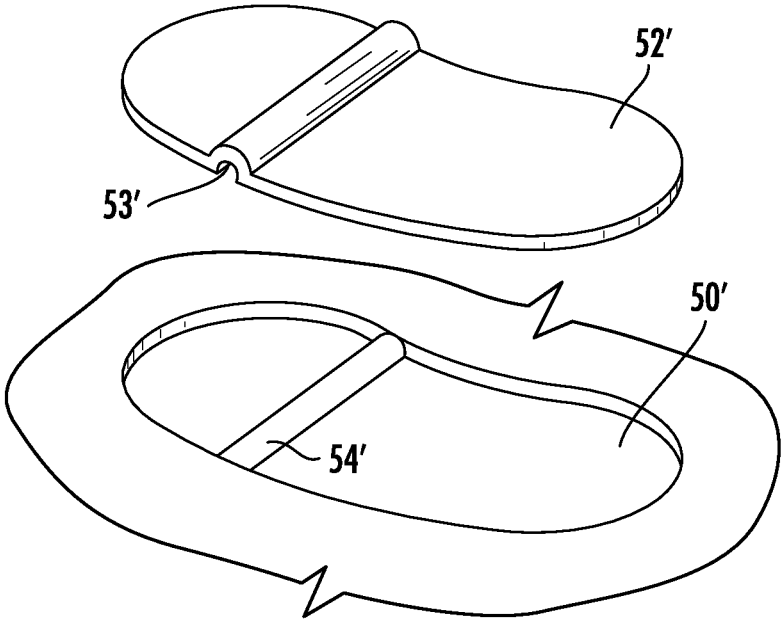
FIG. 17 is a top perspective/exploded view of another embodiment of a mixing flapper valve.
Figure 18:
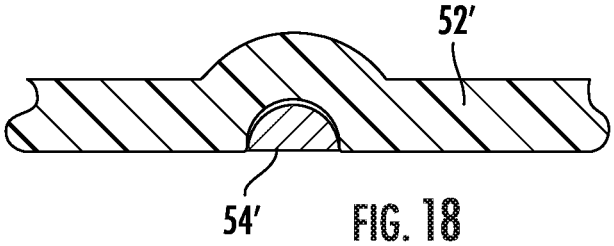
FIG. 18 is a cross-sectional view of the mixing flapper valve illustrated in FIG. 17.
Figure 19:
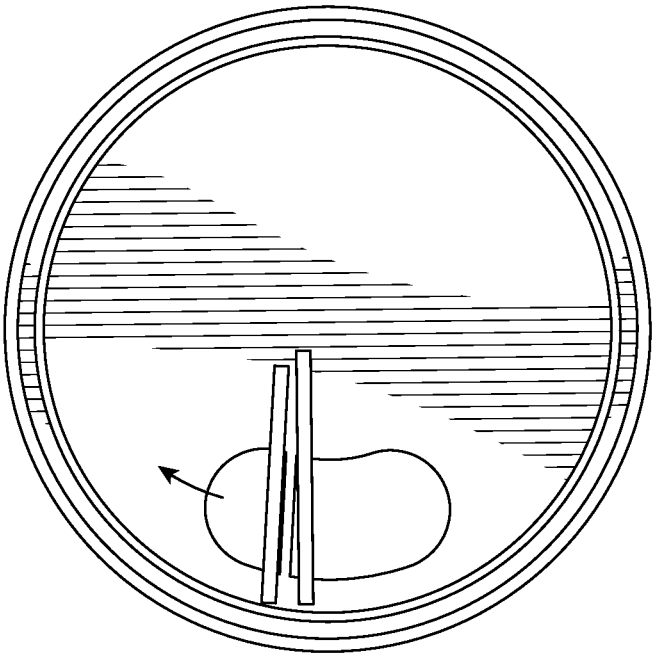
FIG. 19 is cross-sectional top view of the liquid mixing apparatus of FIG. 15, with the mixing flapper valve illustrated in FIG. 17 attached, illustrating the bottom wall and attached components in a closed and locked orientation.

Turning now to FIGS. 17 and 18, another embodiment of mixing flapper valve 52' is pivotally attached in opening 50 by means of a pivot pin 54'. In this example, pivot pin 54' is a half-round or round extension positioned between opposite edges of opening 50' and preferably formed as an integral part of horizontal wall 32'. Flapper valve 52' is the same shape as opening 50' and is formed to fit snuggly into opening 50' to substantially prevent fluid (i.e. liquid 42) from flowing through opening 50' when in the closed position. A downwardly directed channel 53' is formed in flapper valve 52' with a semicircular cross-section to mate with pivot pin 54' and allow limited relative pivotal movement of flapper valve 52'. Thus, flapper valve 52 is pivotally positioned in opening 50' and is free to pivot, clockwise in FIG. 17, from a closed position into an open or mixing orientation. Because the formation of channel 53' causes a slight ridge in the upper surface of flapper valve 52', stop bar 62 and activating bar 64 are separated slightly, as illustrated in FIG. 19, in the closed and locked orientation.

Figure 20:
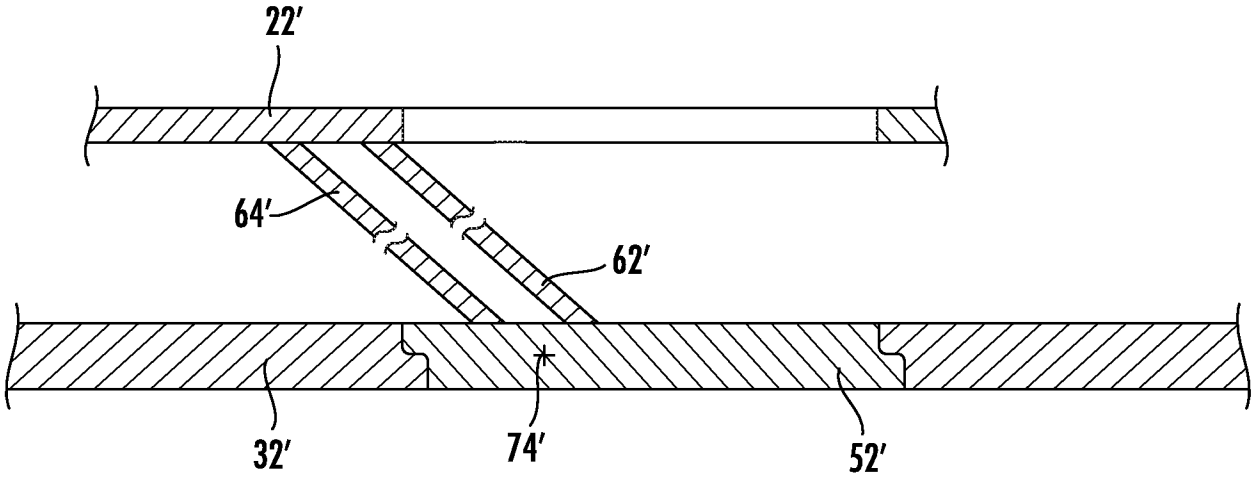
FIG. 20 illustrates another embodiment of the stop and activating bars illustrated in FIG. 8.

Turning to FIG. 20 another embodiment of stop bar 62 and activating bar 64 is illustrated in a view similar to FIG. 8 above. In this embodiment components similar to those in FIG. 8 are designated with similar numbers and a prime (') is added to indicate the different embodiment. In this embodiment stop bar 62' and activating bar 64' are slanted with the horizontal at an angle (e.g. 45 degrees) to enhance the flow of liquid from container 10 into liquid mixing apparatus 12' during the mixing process and after it is completed and the user uses liquids directly from top pour opening 17 or pours the mixed liquid from top pour opening 17 into another container.

Many other structures or modifications may be devised by the skilled artisan and all such structures or modifications are believed to come within the scope of this invention.

In the use and operation of liquid mixing apparatus 12, it is important to understand the relationship and relative movements of the various components. For purposes of explanation, spirits or alcoholic drinks will be used. Initially, liquid mixing apparatus 12 is filled with a liquid 42 to be mixed with a liquid contained in liquid container 10, generally by a manufacturer or distributor. A flexible seal 70 is removably affixed over the lower surface of opening 50 to seal opening 50 and preserve liquid 42. It will be understood by artisans in the field that liquid mixing apparatus 12 in the sealed condition will have a substantial shelf life.

A user acquires drink mixing apparatus 12 filled with liquid (e.g. an alcoholic beverage) 42 and also selects a drink container 10 to be included in the mixing process. Initially, tab 18 of drink container 10 is opened in the normal manner and seal 70 is removed from drink mixing apparatus 12. Drink mixing apparatus 12 is snap-fit onto upwardly extending lip 19 of drink container 10. The user then grips drink container 10 with one hand and grips housing 20 of drink mixing apparatus 12 with the other hand. The two components are twisted or rotated so that housing 20 moves clockwise relative to drink container 10 (see FIG. 12) and bottom assembly 30. Preferably, clockwise rotation will continue until activating bar 64 moves to a position adjacent the right-hand side of stop bar 62 (i.e. substantially 360 degrees). Movement of activating bar 64 from its initial position overlying and locking flapper valve 52 not only allows flapper valve 52 to pivot or rotate but forces liquid 42 against stop bar 62 and down against flapper valve 52 which actively rotates flapper valve 52 open and forces liquid 42 down through portion 50*a* of opening 50. Because moving liquid 42 into drink container 10 will result in an excessive amount of liquid in drink container 10, the excess liquid will be forced up and through portion 50*b* of opening 50 filling the voided space which produces a vigorous mixing effect. Once activating bar 64 is moved to its stop position, the mixed drink can be dispensed by opening pull-tab 28 and the user can either drink directly from top pour opening 17 or can pour the mixed liquid from top pour opening 17 into another container.

Thus, liquid mixing apparatus is disclosed that conveniently and efficiently mixes a first liquid into a second liquid in an accurate mix to produce a third liquid composed of the mixed first liquid and second liquid. Generally, the two liquids will have similar viscosity and density. As stated previously, while the preferred embodiment gives examples of consumable liquids, one of ordinary skill will understand that the liquids being mixed can be for consumption or for other utilities, e.g. petroleum products. Generally, the present invention is intended to be used to mix a first liquid, carried by the mixing apparatus of the present invention, into a second liquid, carried by a container to which the mixing apparatus of the present invention can be attached, to produce a third liquid composed of the mixed first liquid and second liquid. In a preferred and specific use of the present invention drink mixing apparatus is disclosed that contains a spirit or the like and which can be conveniently attached to a typical drink container. Once the drink mixing apparatus is attached to a typical drink container, the drink mixing apparatus can be activated and a fully mixed drink is produced. The fully mixed drink can be consumed by drinking directly from the drink mixing apparatus or by pouring all or a portion of the fully mixed drink into another container (e.g. a glass, cup, etc.).

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Liquid mixing apparatus comprising:

a housing having an upper containment wall and an open lower end, the upper containment wall including a pour opening normally sealed with a closure;

a bottom assembly including a horizontal wall extending across the open lower end of the housing and sealingly engaged in the open lower end for relative rotation between the housing and the bottom assembly, the bottom assembly forms a liquid sealed cavity with the housing, the bottom assembly further including connecting apparatus for removably attaching the bottom assembly to a liquid container;

a mixing opening defined in the horizontal wall of the bottom assembly and a flapper valve pivotally mounted in the mixing opening for pivotal movement between a closed orientation in which liquid in the cavity cannot flow through the mixing opening and an open orientation in which the liquid can flow through the mixing opening;

a stop bar attached at a lower surface to the upper surface of the horizontal wall and extending across the mixing opening; and an activating bar affixed to the housing for rotation with the housing, the activation bar movable relative the bottom assembly between a locking position overlying the flapper valve adjacent a side of the stop bar, and an unlocked position.

2. The liquid mixing apparatus as claimed in claim 1 wherein the unlocked position of the activating bar overlies the flapper valve adjacent an opposing side of the stop bar whereby the activating bar forces the liquid in the cavity to pivot the flapper valve into the open orientation in which the liquid can flow through the mixing opening.

3. The liquid mixing apparatus as claimed in claim 1 wherein the bottom assembly includes a sealing ring extending around a periphery of the horizontal wall, the sealing ring sealingly engaging an inner surface of the housing adjacent the open lower end, and the sealing ring engaging the inner surface of the housing to allow relative rotation between the housing and the bottom assembly.

4. The liquid mixing apparatus as claimed in claim 3 wherein the sealing ring has an outwardly opening groove extending entirely around an outer periphery thereof, and an inwardly directed tongue extends from the inner periphery of the housing proximate the open lower end, the inwardly directed tongue received within the outwardly opening groove to sealingly engage the sealing ring with the housing while allowing relative rotation therebetween.

5. The liquid mixing apparatus as claimed in claim 3 wherein the sealing ring further includes a downwardly opening ring-shaped channel designed to sealingly engage an upwardly extending lip of the liquid container.

6. The liquid mixing apparatus as claimed in claim 3 wherein the sealing ring includes a downwardly directed U-shaped channel around the entire outer periphery and the lower edge of the housing is bent inwardly and upwardly around the entire periphery to form an upwardly directed U-shaped channel, the downwardly directed U-shaped channel fits within the upwardly directed U-shaped channel to sealingly engage the sealing ring with the housing while allowing relative rotation therebetween.

7. The liquid mixing apparatus as claimed in claim 6 wherein one of the downwardly directed U-shaped channel and the upwardly directed U-shaped channel is coated with a material that allows relative rotation therebetween.

8. The liquid mixing apparatus as claimed in claim 6 wherein the sealing ring also includes a downwardly opening ring-shaped channel designed to sealingly engage an upwardly extending lip of the liquid container.

9. The liquid mixing apparatus as claimed in claim 8 wherein the downwardly opening ring-shaped channel has a diameter approximately the same as a diameter of the upwardly extending lip of the liquid container and the ring-shaped channel is sized to snap-fit onto the upwardly extending lip of the liquid container.

10. The liquid mixing apparatus as claimed in claim 1 wherein the stop bar extends radially along the upper surface of the horizontal wall from adjacent an inner surface of the housing to approximately a central point of the housing.

11. The liquid mixing apparatus as claimed in claim 1 wherein the activating bar extends radially along the lower surface of the upper containment wall from adjacent an inner surface of the housing to approximately a central point of the housing.

12. The liquid mixing apparatus as claimed in claim 1 further including a flexible seal removably affixed to the lower surface of the horizontal wall of the bottom assembly over the mixing opening in the horizontal wall of the bottom assembly.

13. Liquid mixing apparatus comprising:

a housing having an upper containment wall and an open lower end, the upper containment wall including a pour opening normally sealed with a pull-tab;

a bottom assembly including a horizontal wall extending across the open lower end of the housing and a sealing ring extending around a periphery of the horizontal wall, the sealing ring sealingly engaging an inner surface of the housing adjacent the open lower end, and the sealing ring engaging the inner surface of the housing to allow relative rotation between the housing and the bottom assembly, the bottom assembly forms a liquid sealed cavity with the housing;

the bottom assembly further including connecting apparatus for removably attaching the bottom assembly to a liquid container;

a mixing opening defined in the horizontal wall of the bottom assembly and a flapper valve pivotally mounted in the mixing opening for pivotal movement between a closed orientation in which liquid in the cavity cannot flow through the mixing opening and an open orientation in which the liquid can flow through the mixing opening;

a stop bar attached at a lower surface to the upper surface of the horizontal wall, the stop bar extending radially along the upper surface of the horizontal wall from adjacent an inner surface of the housing to approximately a central point of the housing and extending across a mid-portion of the mixing opening; and an activating bar affixed to the housing for rotation with the housing, the activating bar extending radially along the lower surface of the upper containment wall from adjacent an inner surface of the housing to approximately a central point of the housing, whereby relative rotation between the housing and the bottom assembly moves the activating bar within the cavity, forcing the liquid in the cavity to pivot the flapper valve into the open orientation in which the liquid can flow through the mixing opening.

14. The liquid mixing apparatus as claimed in claim 13 further including a flexible seal removably affixed to the lower surface of the horizontal wall of the bottom assembly over the mixing opening in the horizontal wall of the bottom assembly.

15. A method of mixing single serving drinks comprising the steps of:

providing a drink container including a body with an upper sealing wall having a top pour opening sealed with a closure and an upwardly extending lip which extends above the upper sealing wall;

providing single serving drink mixing apparatus comprising:

a housing having an upper containment wall and an open lower end, the upper containment wall including a pour opening normally sealed with a pull-tab;

a bottom assembly including a horizontal wall extending across the open lower end of the housing and sealingly engaged in the open lower end for relative rotation between the housing and the bottom assembly, the bottom assembly forms a liquid sealed cavity with the housing, the bottom assembly further including connecting apparatus for removably attaching the bottom assembly to a drink container, a mixing opening defined in the horizontal wall of the bottom assembly and a flapper valve pivotally mounted in the mixing opening for pivotal movement between a closed orientation in which liquid in the cavity cannot flow through the mixing opening and an open orientation in which the liquid can flow through the mixing opening;

a stop bar attached at a lower surface to the upper surface of the horizontal wall and extending across the mixing opening;

an activating bar affixed to the housing for rotation with the housing, the activation bar movable relative the bottom assembly between a locking position overlying the flapper valve adjacent a side of the stop bar, and an unlocked position; and a flexible seal removably affixed to a lower surface of the horizontal wall of the bottom assembly over the mixing opening in the horizontal wall of the bottom assembly;

removing the closure from the top pour opening in the drink container and removing the flexible seal over the mixing opening;

removably attaching the bottom assembly to the upwardly extending lip of the drink container;

rotating the housing relative to the bottom assembly; and removing the closure from the pour opening.

16. A method of mixing single serving drinks as claimed in claim 15 wherein the step of rotating the housing relative to the bottom assembly includes rotating the housing until the activating bar moves from the locking position above the flapper valve to the unlocked position.

17. A method of mixing single serving drinks as claimed in claim 15 wherein the step of rotating the housing relative to the bottom assembly includes rotating the housing until the activating bar moves from the locking position above the flapper valve adjacent the side of the stop bar to the unlocked position adjacent an opposite side of the stop bar thereby forcing the liquid through the mixing opening on the opposite side of the stop bar of the single serving drink mixing apparatus into the drink container in a swirling/mixing motion and forcing excess liquid from the drink container back through the mixing opening on the side of the stop bar into the single serving drink mixing apparatus.

* * * * *